US008426784B2

(12) United States Patent
Drozd

(10) Patent No.: US 8,426,784 B2
(45) Date of Patent: Apr. 23, 2013

(54) MULTI-STAGE CYLINDRICAL WAVEGUIDE APPLICATOR SYSTEMS

(75) Inventor: Esther Drozd, Cary, NC (US)

(73) Assignee: Industrial Microwave Systems, LLC, Morrisville, NC (US)

( * ) Notice: Subject to any disclaimer, the term of this patent is extended or adjusted under 35 U.S.C. 154(b) by 1234 days.

(21) Appl. No.: 12/175,483

(22) Filed: Jul. 18, 2008

(65) Prior Publication Data

US 2010/0012650 A1 Jan. 21, 2010

(51) Int. Cl.
*H05B 6/72* (2006.01)
*H05B 6/70* (2006.01)

(52) U.S. Cl.
USPC ..... 219/695; 219/696

(58) Field of Classification Search ..... 219/695, 219/696, 690, 750, 679, 686, 693, 746, 756, 219/762, 700, 701; 333/21 R, 125, 137, 333/34, 239, 248, 227, 228, 230; 264/433
See application file for complete search history.

(56) References Cited

U.S. PATENT DOCUMENTS 3,555,232 A 1/1971 Bleackley
5,834,744 A 11/1998 Risman
5,958,275 A 9/1999 Joines et al.
5,998,774 A 12/1999 Joines et al.
6,265,702 B1 7/2001 Drozd et al.
6,396,034 B2 5/2002 Drozd et al.
6,740,858 B2 5/2004 Tracy et al.
6,797,929 B2 9/2004 Drozd et al.
6,906,297 B2 6/2005 Tops
7,470,876 B2 12/2008 Drozd et al.

OTHER PUBLICATIONS

Korean Intellectual Property Office, "PCT/US09/50015 Search Report and Written Opinion of the International Searching Authority," Feb. 5, 2010, KIPO, Daejon, Korea.

*Primary Examiner* — Quang Van
(74) *Attorney, Agent, or Firm* — James T. Cronvich

(57) ABSTRACT

A microwave applicator system exposing a material flowing through multiple applicator stages to a different radial heating pattern in each stage for uniform heating. A two-stage applicator system has a pair of back-to-back applicators, each having offset, outwardly jutting walls on opposite sides of a material flow path through a microwave exposure region. The offset, cylindrical juts formed in the wide walls of the generally rectangular waveguide cause hot spots to occur in material flowing through and between the narrow walls of the waveguide at opposite radial positions on a radial line oblique to the longitudinal direction of the waveguide. Uniform product heating can be achieved by directing a material sequentially through these two applicators in opposite directions. A cascaded applicator in which each wide wall has a pair of outward juts offset from each other and from the pair of juts on the other side wall may be used. Other multi-stage applicator systems may be used to expose a flowing material to multiple heating patterns to achieve uniform heating.

25 Claims, 5 Drawing Sheets

MULTI-STAGE CYLINDRICAL WAVEGUIDE APPLICATOR SYSTEMS

BACKGROUND

The invention relates generally to microwave heating and, more particularly, to heating a material flowing through a waveguide applicator.

Cylindrical waveguide applicators, such as the applicator in the Model CHS microwave heating system manufactured and sold by Industrial Microwave Systems, L.L.C. of Morrisville, N.C., U.S.A., are used to heat material flowing through the applicator in a flow tube. The tube is positioned in a focal region of the cylindrical applicator to subject the flowing material to a concentrated, but uniform heating pattern. The geometry of the applicator and the dielectric properties of the material to be heated largely determine the position and radial extent of the focal region. For many applications, a tightly focused focal region works best. But that requires a small-diameter flow tube precisely positioned in the cylindrical applicator's narrow focal region for efficient, uniform heating. And changing the position of the focal region and its concentration is difficult. Consequently, uniformly heating material flowing in a larger flow tube and adjusting the focus of the microwave energy is difficult without changing the geometry of the cylindrical applicator.

Thus, there is a need for a microwave applicator that overcomes some of these shortcomings.

SUMMARY

According to one aspect of the invention, a waveguide applicator comprises a waveguide formed by a pair of parallel first and second narrow walls having opposite edges and a pair of opposite first and second wide walls connected between the opposite edges of the pair of narrow walls. The waveguide extends in length from a first end to a second end, closed by an end wall. A port at the first end of the waveguide allows an electromagnetic wave to propagate into the waveguide. Openings in the narrow walls define a flow path along which a material to be heated traverses the waveguide through the narrow walls. A first jut in the first wide wall and a second jut in the second wide wall are offset from each other along the length of the waveguide.

In another aspect of the invention, a waveguide applicator system comprises a first waveguide applicator stage having a microwave exposure region into which electromagnetic energy propagates and a second waveguide applicator stage having a microwave exposure region into which electromagnetic energy propagates. Tubing extending through the microwave exposure regions of the first and second waveguide applicator stages defines a material flow path. A material to be exposed to the electromagnetic energy flows sequentially through the first and second waveguide applicator stages along the flow path. The heating pattern of the material flowing through the first waveguide applicator stage differs from the heating pattern of the material flowing through the second waveguide applicator stage. In this way, hot spots are not formed at the same positions in the material in both stages.

In yet another aspect of the invention, a method for heating a flowable material comprises: (a) flowing a material in a tube through a first microwave exposure region creating a first heating pattern in the flowable material; and (b) flowing the material in a tube through a second microwave exposure region creating a second heating pattern in the flowable material different from the first heating pattern.

BRIEF DESCRIPTION OF THE DRAWINGS

These features and aspects of the invention, as well as its advantages, are better understood by reference to the following description, appended claims, and accompanying drawings, in which:

DETAILED DESCRIPTION

Figure 1:
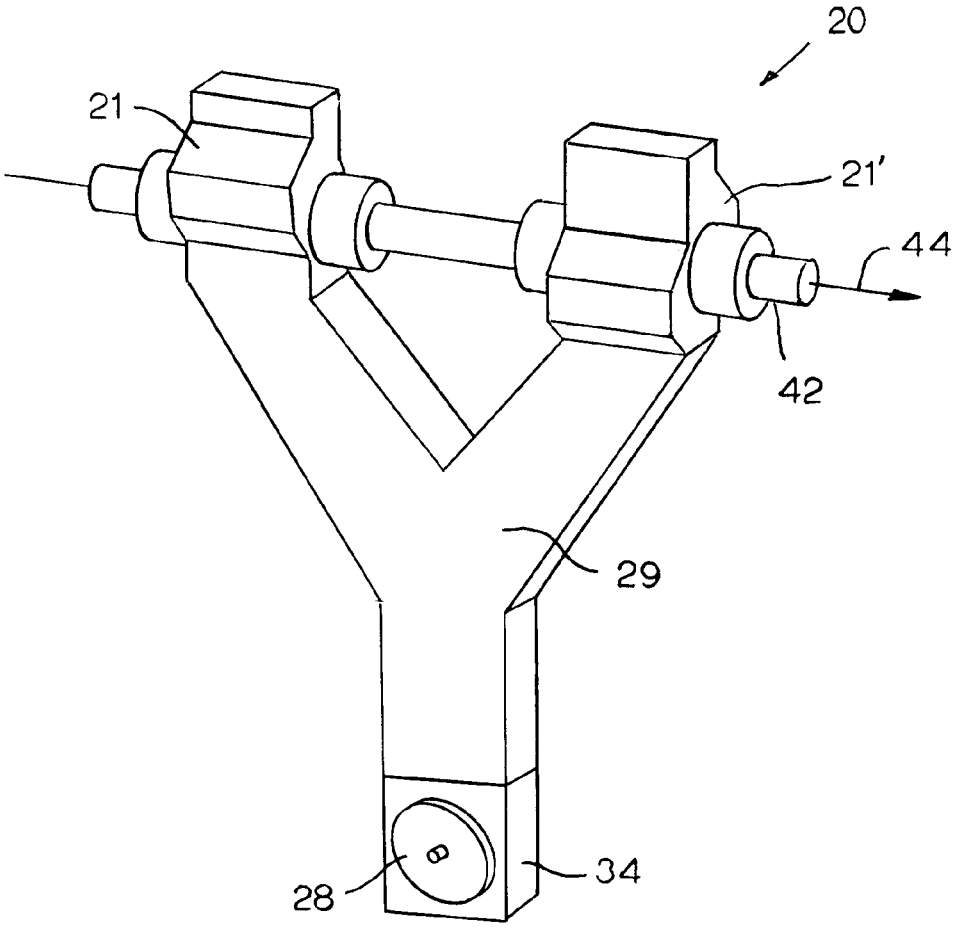
FIG. 1 is an oblique view of a two-stage waveguide applicator system embodying features of the invention, including two single-offset applicators back to back.
Figure 2:
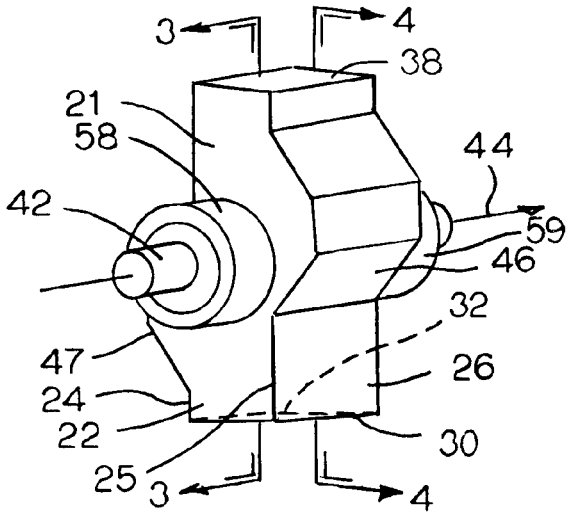
FIG. 2 is an oblique view of one of the single-offset waveguide applicators of FIG. 1.
Figure 3:
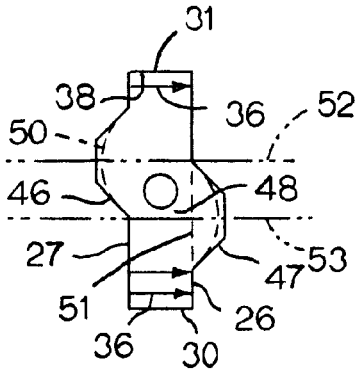
FIG. 3 is a scaled-down cross section of the waveguide applicator of FIG. 2, taken along lines 3-3.
Figure 4:
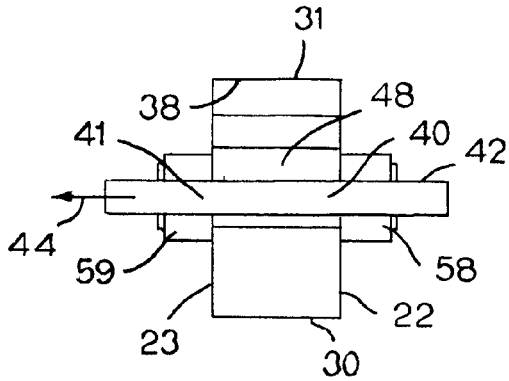
FIG. 4 is a scaled-down cross section of the waveguide applicator of FIG. 2, taken along lines 4-4.

A two-stage microwave applicator system embodying features of the invention is shown in FIG. 1. The applicator system 20 includes a pair of applicators 21, 21'. The structure of the individual applicators is described with reference to FIGS. 2-4. Each applicator 21 is formed by a pair of parallel, narrow conductive walls 22, 23 joined at opposite edges 24, 25 to a pair of wide walls 26, 27. As shown in FIG. 1, the applicators are energized by a microwave source 28, such as a magnetron, through a Y-shaped power splitter 29. An electromagnetic wave is injected into a first end 30 of each applicator through a port 32 via the power splitter and a launcher section 34 that would include a conventional circulator and load (not shown) to protect the microwave source from reflected energy. The electromagnetic wave, which has an electric field 36 directed between the wide walls, propagates along the length of the waveguide to an end wall 38 at the waveguide's second end 31. The conductive end wall reflects the wave back toward the microwave source.

Openings 40, 41 in the narrow walls of each applicator admit tubing 42 into the interior of the applicator. The tubing, which is made of a microwave-transparent material, defines a material flow path 44 along which a flowable material to be heated by the applicator flows. Some examples of flowable materials are liquids, emulsions, and suspensions. The two wide walls 26, 27 include outward juts 46, 47 flanking a microwave exposure region 48 encompassing the material flow path. The direction of the electric field lines launched into the exposure region is transverse to the material flow path and to the electromagnetic wave's longitudinal direction of propagation, which is transverse to the material flow path. The juts are longitudinally offset from each other along the length of the waveguide on opposite sides of the flow path. The juts in the wide walls are shown as isosceles trapezoidal cylinders that extend from narrow wall to narrow wall. But they could alternatively be realized as portions of circular cylinders 50 as shown by the broken lines in FIG. 3. Or the applicator could have a jut on only one side as indicated by the dotted line 51 signifying a flat wide wall opposite the jut 46.

Figure 5A:
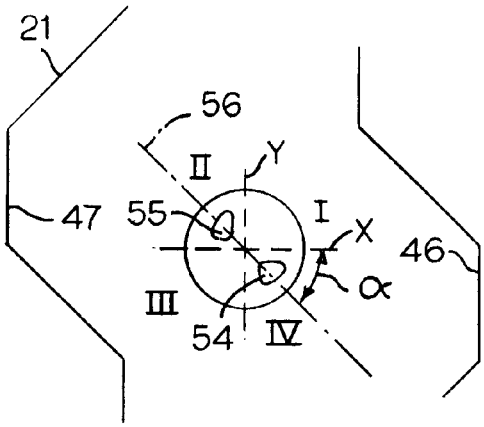
FIGS. 5A and 5B are representations of the radial heating patterns of the material within a flow tube in the two applicators of FIG. 1.
Figure 5B:
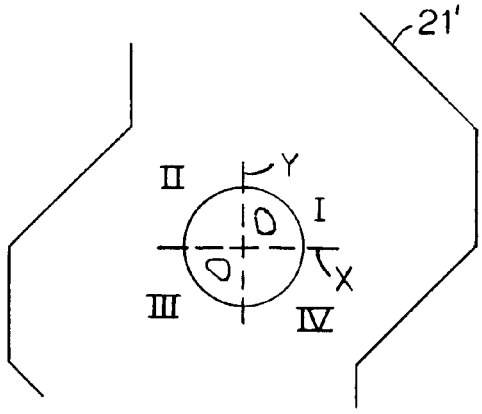

The cylindrical juts are preferably congruent and positioned with their planes of symmetry 52, 53 parallel to and on diametrically opposite sides of the flow path in an overlapping arrangement. The offset juts guide the electromagnetic wave around the material flow path in such a way that hot spots 54, 55 form, for example, heated material at positions in quadrants II and IV, rather than on-axis, in the x-y coordinate system shown in FIG. 5A for the entry applicator stage 21 of FIG. 1. In this example, the hot spots are formed at radially opposite positions on a radial line 56 that is oblique to the longitudinal direction of the waveguide represented by the y axis. The angle $\alpha$ of the hot spots depends on, besides the dielectric properties of the material, the relative offset of the two juts 46, 47. The radial heating pattern of the exit applicator stage 21' is shown in FIG. 5B. As shown in FIG. 1, material flowing through the tubing 42 exits the opening in the second narrow wall 23 of the leftmost waveguide applicator 21 and enters the rightmost waveguide applicator 21' through its second narrow wall. Thus, material flows sequentially through the applicators in opposite directions relative to the positions of the juts. In this way, because the microwave exposure regions are essentially mirror images of each other, the material is subjected to hot spots in quadrants II and IV in the leftmost applicator (FIG. 5A) and hot spots in quadrants I and III in the rightmost applicator (FIG. 5B) for a more uniform heat treatment in the applicator system without physically mixing the material. The outward juts in the waveguide direct some of the energy around the material to be heated. This diversion of a portion of the energy, along with the orientation of the electric field transverse to the flow path through the applicator, reduces the sensitivity of the applicator to the dielectric properties of the material. Tunnels 58, 59 at the material entrance and exit openings 40, 41 help attenuate microwave leakage from the applicator.

Figure 6:
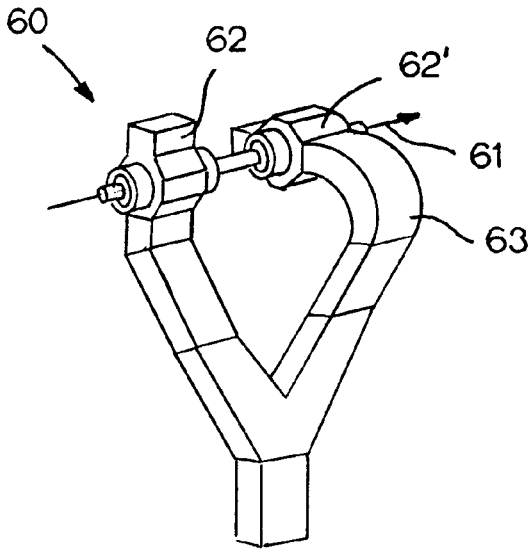
FIG. 6 is an isometric view of another two-stage waveguide applicator system embodying features of the invention, including symmetrical applicators fed from different directions.

Another two-stage applicator system providing uniform heating is shown in FIG. 6. This applicator system 60 uses two non-offset, symmetrical applicators 62, 62' to heat a flow of material 61. This system differs from the system of FIG. 1 in that the individual applicators are rotated 90° relative to each other about the flow path. Microwave energy enters the first stage 62 vertically from below and the second stage 62' horizontally in the reference frame of FIG. 6 to create heating patterns generally identical to each other, but rotated by 90°. A curved waveguide section 63 is used in the non-coplanar waveguide arrangement to feed microwave energy into the second stage. In this way, the material, which is sequentially subjected to two different heating patterns with non-coincident hot spots, is heated more uniformly.

Figure 7:
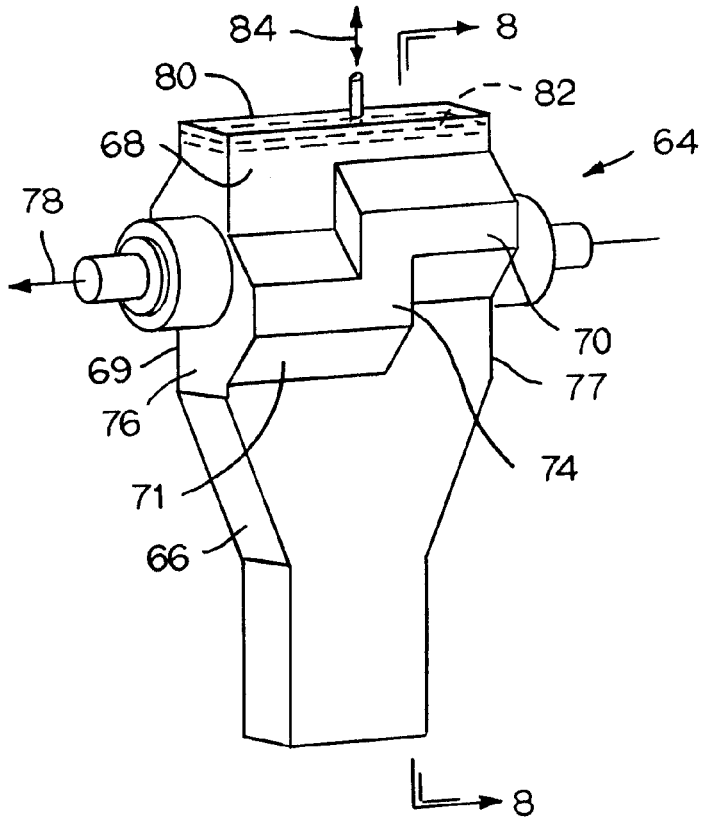
FIG. 7 is an oblique view of a cascaded two-stage waveguide applicator embodying features of the invention.
Figure 8:
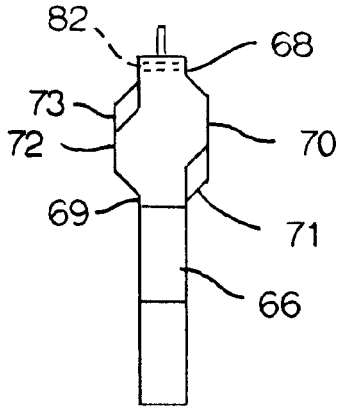
FIG. 8 is a scaled-down cross section of the cascaded waveguide applicator of FIG. 7 taken along lines 8-8.

Another version of a microwave applicator system providing uniform heating and the advantages of the two-stage applicators of FIGS. 1-6 is shown in FIGS. 7 and 8. The cascaded applicator 64 is effectively made by joining the left and right applicators of FIG. 1 into a single applicator. The cascaded applicator is wider than each single applicator and includes a tapered waveguide section 66 to connect the narrower launch section to the wider exposure region. Each wide wall 68, 69 of the waveguide has a pair of outward juts 70, 71; 72, 73. The juts on each wall communicate with each other in a junction section 74 generally midway between the waveguide's opposite narrow walls 76, 77. The junction section essentially divides the cascaded applicator into two applicator stages. So, for example, material flowing through the cascaded applicator in the direction of arrow 78 and exposed to hot spots in quadrants II and IV along the first half of the flow path is exposed to hot spots in quadrants I and III in the second half. In this way, the cascaded applicator uniformly heats the material as it flows sequentially through the two stages.

As shown in FIGS. 7 and 8, an end wall 80 may be replaced by a conductive plate 82 that may be moved along the length of the waveguide as indicated by arrow 84 to tune the applicator for a preferred performance. Furthermore, the movable plate can be removed to provide access to the interior of the waveguide applicator for cleaning and inspection. Such a movable plate may be used in the applicators shown in FIGS. 1-6 as well.

Figure 9:
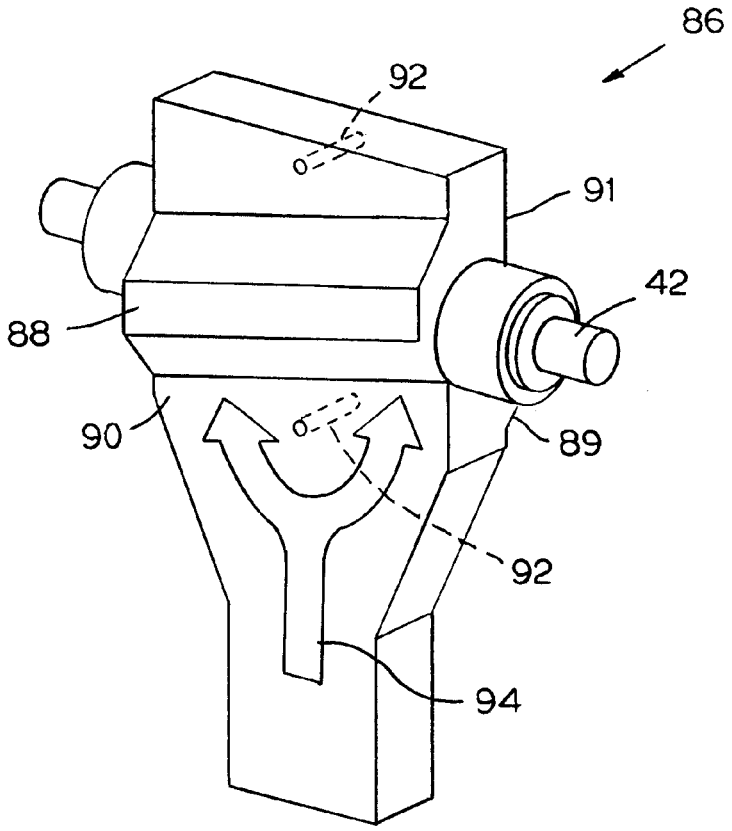
FIG. 9 is an isometric view of another version of a cascaded two-stage waveguide applicator embodying features of the invention, including oppositely angled wall juts.

A variation of the cascaded applicator of FIGS. 7 and 8 is shown in FIG. 9. The applicator 86 replaces the two-step juts of FIG. 7 with linear juts 88, 89 diagonally arranged on wide walls 90, 91 of the waveguide. The jut 88 on the facing side in the figure angles opposite to the jut 89 on the other side. The planes of symmetry of the juts intersect along a line intersecting the wide walls and the material flow path. Except for the region around the intersection of the planes of symmetry, at which the juts overlap, the juts are longitudinally offset from each other across the microwave exposure region. In a preferred arrangement, conductive bars 92 extend from one wide wall to the other across the exposure chamber on opposite sides of the flow tube 42. The bars effectively act as a virtual wall and power splitter, dividing the electromagnetic power generally evenly between each half of the applicator as indicated by bifurcated arrow 94. In this way, material flowing through the flow tube is exposed to a first heating pattern in one half (effectively, a first stage) of the applicator and a different second heating pattern in the other half (a second stage) for a more uniform heat treatment. Of course, the power-splitting bars could be used in the cascaded applicator of FIG. 7 to similar effect. And the conductive plate shown in the cascaded applicator of FIG. 7 could be used with this applicator.

Figure 10A:
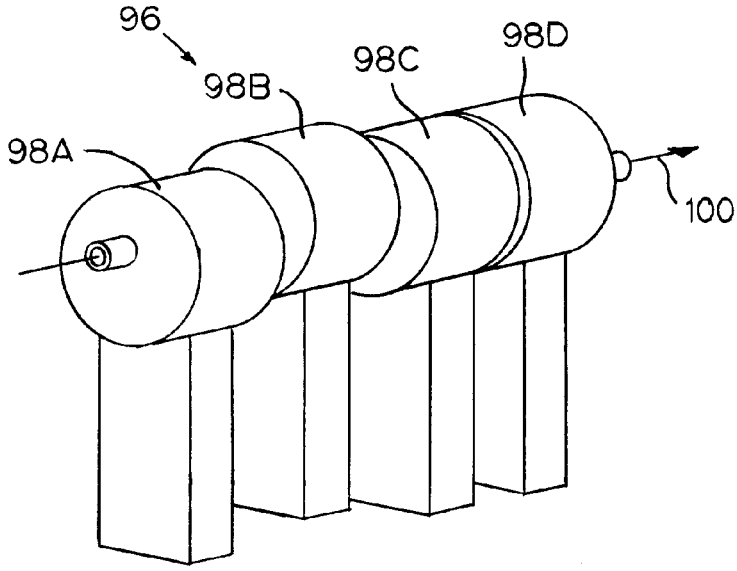
FIGS. 10A-10C are isometric, side elevation, and top plan views of a four-stage waveguide applicator system embodying features of the invention.
Figure 10B:
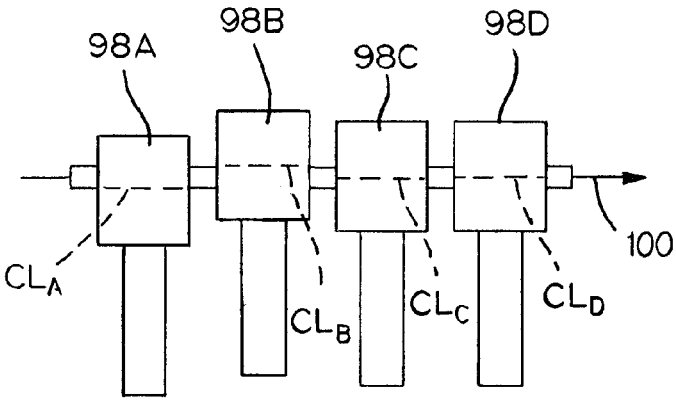
Figure 10C:
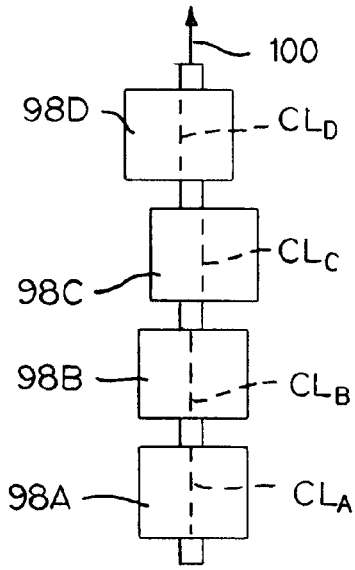

A four-stage waveguide applicator system 96 is shown in FIGS. 10A-10C. As shown, each of the four applicators 98A-98D forming the four stages is a generally cylindrical applicator. The material flow path 100 traverses each applicator along an eccentric path parallel to the centerline of each applicator. As shown in FIGS. 10B and 10C, the path through the first stage 98A is above the centerline $CL_A$ of the applicator, but centered left to right. The path through the second stage 98B is below the centerline $CL_B$ and centered left to right. The path through the third stage 98C is level with the centerline $CL_C$, but offset to the left. The path through the fourth stage 98D is also level with the centerline $CL_D$, but shifted to the right. Consequently, even if each cylindrical applicator is structurally identical to the others, the material flowing through the applicator system along four geometrically different paths relative to the direction of propagation of the electromagnetic wave is exposed to four different heating patterns—one in each stage.

Although the invention has been described in detail with reference to a few preferred versions, other versions are possible. For example, applicator systems having three, five, or more applicator stages could be used to expose the flowing material to a different heating pattern in each stage to improve heating uniformity. As another example, the flow tube could traverse the exposure region of the applicator along a path skewed or non-parallel relative to the centerline of the applicator to expose the material to varying heating patterns. So, as these few examples suggest, the scope of the claims is not limited to the preferred versions described in detail.

What is claimed is:

1. A waveguide applicator system comprising:

a first waveguide applicator stage having walls with one or more outward juts and a microwave exposure region into which electromagnetic energy propagates;

a second waveguide applicator stage having walls with one or more outward juts and a microwave exposure region into which electromagnetic energy propagates;

tubing extending through the microwave exposure regions of the first and second waveguide applicator stages and defining a material flow path through which a material to be exposed to the electromagnetic energy flows sequentially through the first and second waveguide applicator stages;

wherein the one or more outward juts in the first waveguide applicator stage are positioned relative to the material flow path differently from the one or more outward juts in the second waveguide applicator stage to cause the heating pattern of the material as it flows through the first waveguide applicator stage to differ from the heating pattern of the material as it flows through the second waveguide applicator stage to prevent hot spots from forming in the material at the same positions in both stages.

2. A waveguide applicator system as in claim 1 wherein the first waveguide applicator stage and the second waveguide applicator stage are individual, spaced apart waveguide applicators.

3. A waveguide applicator system as in claim 1 wherein the first waveguide applicator stage and the second waveguide applicator stage open into each other with their microwave exposure regions in communication.

4. A waveguide applicator system as in claim 3 further comprising conductive bars positioned between the first and second waveguide applicator stages to divide the electromagnetic power generally evenly between the two stages.

5. A waveguide applicator system as in claim 1 wherein each of the first and second waveguide applicator stages includes a port through which an electromagnetic wave propagates into the microwave exposure region in a direction of propagation and wherein the direction of propagation relative to the material flow path in the first waveguide applicator stage differs from the direction of propagation relative to the material flow path in the second waveguide applicator stage.

6. A waveguide applicator system as in claim 1 wherein each of the first and second waveguide applicator stages includes:

a generally rectangular waveguide structure whose walls include a pair of opposite first walls and a pair of opposite second walls and extending in length from a first end to a second end and enclosing the microwave exposure region, wherein an electromagnetic wave enters the waveguide structure through the first end;

openings in the pair of opposite first walls defining the material flow path through the microwave exposure region;

wherein only one of the second walls has an outward jut; and wherein the tubing is connected between the first and second waveguide applicator stages to guide the material to be exposed through the waveguide applicator stages in opposite directions in each stage relative to the juts.

7. A waveguide applicator system as in claim 1 wherein each of the first and second waveguide applicator stages includes:

a generally rectangular waveguide structure whose walls include a pair of opposite first walls and a pair of opposite second walls and extending in a longitudinal direction from a first end to a second closed end and enclosing the microwave exposure region, wherein an electromagnetic wave enters the waveguide structure through the first end;

openings in the pair of opposite first walls defining the material flow path through the microwave exposure region;

wherein each of the second walls has an outward jut offset in the longitudinal direction from the other about the material flow path to cause hot spots in the material flowing along the material flow path at radially opposite positions on a radial line oblique to the longitudinal direction; and wherein the tubing is connected between the first and second waveguide applicator stages to guide the material to be exposed through the waveguide applicator stages in opposite directions in each stage relative to the juts.

8. A waveguide applicator system as in claim 1 wherein the walls of each of the first and second waveguide applicator stages include:

a pair of parallel first and second narrow walls having opposite edges;

a pair of opposite first and second wide walls connected between the opposite edges of the pair of narrow walls to form a waveguide extending in length from a first end to a second end;

an end wall closing the second end of the waveguide;

and wherein each of the first and second waveguide applicator stages includes:

a port at the first end of the waveguide through which an electromagnetic wave propagates into the waveguide;

openings in the pair of narrow walls to admit the tubing defining the material flow path along which the material to be heated traverses the waveguide through the narrow walls;

a first jut in the first wide wall and a second jut in the second wide wall offset from the first jut along the length of the waveguide; and wherein the tubing is connected from the opening in the second narrow wall of one of the waveguide applicator stages to the opening in the second narrow wall of the other of the waveguide applicator stages to guide a material to be exposed through the waveguide applicator stages in opposite directions.

9. A waveguide applicator system as in claim 1 wherein each of the first and second waveguide applicator stages includes:

a generally rectangular waveguide structure whose walls include a pair of opposite first walls and a pair of opposite second walls and extending in length from a first end to a second end and enclosing the microwave exposure region, wherein an electromagnetic wave enters the waveguide structure through the first end;

openings in the pair of opposite first walls defining the material flow path through the microwave exposure region;

wherein each of the second walls has an outward jut diametrically opposite the other across the material flow path and offset along the length of the waveguide structure; and wherein the tubing is connected between the first and second waveguide applicator stages to guide the material to be exposed through the waveguide applicator stages in opposite directions in each stage relative to the juts.

10. A waveguide applicator system as in claim 9 wherein the juts in each waveguide applicator stage extend along the second walls from one of the first walls to the other.

11. A waveguide applicator system as in claim 9 wherein the juts in each waveguide applicator stage are symmetrical and have planes of symmetry parallel to and on opposite sides of the material flow path.

12. A waveguide applicator system as in claim 9 wherein the juts in each waveguide applicator stage partially overlap each other on opposite sides of the material flow path.

13. A waveguide applicator system as in claim 9 wherein the juts in each waveguide applicator stage are portions of circular cylinders.

14. A waveguide applicator system as in claim 9 wherein the juts in each waveguide applicator stage are isosceles trapezoidal cylinders.

15. A waveguide applicator system comprising:

a first waveguide applicator stage having a microwave exposure region into which electromagnetic energy propagates in a first direction;

a second waveguide applicator stage having a microwave exposure region into which electromagnetic energy propagates in a second direction;

tubing extending through the microwave exposure regions of the first and second waveguide applicator stages and defining a material flow path through which a material to be exposed to the electromagnetic energy flows sequentially through the first and second waveguide applicator stages;

wherein the material flow path through the first waveguide applicator stage and the material flow path through the second waveguide applicator stage are eccentric and follow geometrically different paths relative to the first and second directions so that the heating pattern of the material as it flows through the first waveguide applicator stage differs from the heating pattern of the material as it flows through the second waveguide applicator stage to prevent hot spots from forming in the material at the same positions in both stages.

16. A waveguide applicator comprising:

a pair of parallel first and second narrow walls having opposite edges;

a pair of opposite first and second wide walls connected between the opposite edges of the pair of narrow walls to form a waveguide extending in length from a first end to a second end;

an end wall closing the second end of the waveguide;

a port at the first end of the waveguide through which an electromagnetic wave propagates into the waveguide;

openings in the pair of narrow walls defining a flow path along which a material to be heated traverses the waveguide through the narrow walls;

a first jut in the first wide wall and a second jut in the second wide wall offset from the first jut along the length of the waveguide;

wherein the first and second juts partially overlap each other on opposite sides of the flow path.

17. A waveguide applicator as in claim 16 wherein the first and second juts extend along the first and second wide walls from one of the narrow walls to the other.

18. A waveguide applicator as in claim 16 wherein the first and second juts are symmetrical and have planes of symmetry parallel to and on opposite sides of the flow path.

19. A waveguide applicator as in claim 16 wherein the first and second juts are linear and angle opposite to each other between the first and second narrow walls.

20. A waveguide applicator as in claim 16 wherein the first and second juts are portions of circular cylinders.

21. A waveguide applicator as in claim 16 wherein the first and second juts are isosceles trapezoidal cylinders.

22. A waveguide applicator as in claim 16 further comprising:

a third jut in the first wide wall and a fourth jut in the second wide wall, wherein the first jut is offset along the length of the first wide wall from the third jut and communicates with the third jut generally midway between the pair of narrow walls, and wherein the second jut is offset along the length of the second wide wall from the fourth jut and communicates with the fourth jut generally midway between the pair of narrow walls.

23. A method for heating a flowable material, comprising:

flowing a material in a tube through a first microwave exposure region formed by waveguide structure having a wall with one or more outward juts positioned relative to the tube to create a first heating pattern in the flowable material;

flowing the material in a tube through a second microwave exposure region formed by waveguide structure having a wall with one or more outward juts positioned relative to the flow of the material in the tube differently from the outward juts in the waveguide structure forming the first microwave exposure region to create a second heating pattern in the flowable material different from the first heating pattern.

24. The method of claim 23 wherein the first and second heating patterns are generally rotated versions of each other.

25. The method of claim 23 further comprising:

forming the second microwave exposure region as a mirror image of the first microwave exposure region.

* * * * *